US005945945A

United States Patent [19]

Wagner et al.

[11] Patent Number: 5,945,945

[45] Date of Patent: Aug. 31, 1999

[54] SATELLITE DISH ANTENNA TARGETING DEVICE AND METHOD FOR OPERATION THEREOF

[75] Inventors: David W. Wagner, Burlington; William J. Sherwood, West Burlington, both of Iowa

[73] Assignee: Winegard Company, Burlington, Iowa

[21] Appl. No.: 09/099,601

[22] Filed: Jun. 18, 1998

[51] Int. Cl.[6] ..... H01Q 3/00

[52] U.S. Cl. ..... 342/359; 343/766; 343/882

[58] Field of Search ..... 342/359; 343/766, 343/882

[56] References Cited

U.S. PATENT DOCUMENTS

| | | | |
|---|---|---|---|
| 3,865,265 | 2/1975 | Brudi et al. . | |
| 4,094,073 | 6/1978 | Parra . | |
| 4,503,622 | 3/1985 | Swarz et al. . | |
| 4,621,266 | 11/1986 | Le Gall et al. | 342/359 |
| 4,689,635 | 8/1987 | Haupt | 343/894 |
| 4,707,699 | 11/1987 | Toellner et al. . | |
| 5,077,561 | 12/1991 | Gorton et al. . | |
| 5,227,806 | 7/1993 | Eguchi . | |
| 5,365,671 | 11/1994 | Yaniger . | |
| 5,444,917 | 8/1995 | Nelson . | |
| 5,446,465 | 8/1995 | Diefes et al. . | |
| 5,452,519 | 9/1995 | Crocker et al. . | |

*Primary Examiner*—Theodore M. Blum

*Attorney, Agent, or Firm*—Dorr, Carson, Sloan & Birney, P.C.

[57] ABSTRACT

A satellite dish antenna targeting device which corrects for incline and parabolic offset angle. The satellite dish antenna is connected to a base by a support member so that the satellite dish antenna is able to move through an elevation. An inclinometer is mounted to move in unison with the satellite dish antenna for sensing when the base is oriented at an inclination angle with respect to a tangent to the earth at a location where the satellite dish antenna is being targeted. The inclinometer further senses the elevation the satellite dish antenna moves through. The inclinometer thereby provides a dish elevation corrected for the incline and elevation of the satellite dish antenna to a microprocessor. The microprocessor corrects the dish elevation for the parabolic offset angle of the satellite dish antenna. A display device connected to the microprocessor displays a corrected dish elevation of the satellite dish antenna. The satellite dish antenna is thus rapidly and accurately positioned within one degree to receive the satellite signal by moving the satellite dish antenna until the display device displays a predetermined target elevation compensated for by the incline and/or parabolic offset angle of the satellite dish antenna.

16 Claims, 5 Drawing Sheets

SATELLITE DISH ANTENNA TARGETING DEVICE AND METHOD FOR OPERATION THEREOF

BACKGROUND OF THE INVENTION

1. Field of the Invention

The present invention pertains to a device for targeting a satellite dish antenna at a satellite, and, more particularly, to an apparatus which allows a user to adjust the orientation of the satellite dish antenna mounted on a vehicle while viewing the elevation of the satellite dish antenna that has been compensated for by a parabolic offset angle and any inclination angle of the vehicle.

2. Statement of the Problem

Satellite antenna systems have become an increasingly popular method to receive television programming signals. Digital programming is now delivered by several companies using satellites to transmit signals to earth-based satellite dishes. These antenna systems are typically installed on fixed surfaces, such as on buildings or homes. Some consumers install small satellite dish antennas on recreational vehicles (RVs). When the antenna system is mounted on an RV, the vehicle must either be leveled before using the satellite antenna system or any inclination must be manually compensated for before targeting the antenna dish at the satellite.

Before the satellite dish antenna is targeted at the satellite, the user must know the target elevation required to receive a signal from a satellite at the location of the satellite dish antenna. Conventionally, the target elevation is obtained by inputting the local zip code of the location of the satellite dish antenna, into a satellite receiver system. The user then adjusts the orientation of the satellite dish antenna first by adjusting the azimuth to a predetermined setting, and then the elevation until the elevation of the satellite dish antenna corresponds to the target elevation obtained from the receiver.

Conventional systems, whether stationary or mobile, require the user to provide a level surface for the antenna system to accurately target the elevation of the satellite dish antenna. Absent a level surface, the user is required to compensate for the incline to target the satellite dish antenna to receive the signal from the satellite at a particular location.

Conventional systems with an offset antenna feed further require the user to compensate for a parabolic offset angle associated with the antenna dish. An antenna feed inevitably creates a shadow between the signal and the satellite dish antenna where the signal cannot reach. On large dishes, this shadow is inconsequential. However, as a result of the popularity of mobile satellite antenna systems, antenna dishes have become increasingly smaller. Thus, reception by smaller antenna dishes begins to suffer as the shadow cast on the satellite dish by the antenna feed grows proportionally larger with respect to the decreasing size of the satellite dish. To provide better reception, designers offset the antenna feed with respect to the center of the dish. Because the signal is reflected to a feed at the center of the conventional dish, the dish with an offset feed must be adjusted to reflect the incoming signal to the offset feed. This adjustment is expressed as an angle, measured between the face of a normal parabolic antenna dish targeted to receive a signal (or measured between a plane perpendicular to the incoming signal) and the face of an antenna dish with an offset antenna feed set to reflect the incoming signal to the offset antenna feed. This angle is known as the parabolic offset angle and is typically provided by the manufacturer in the specifications for the antenna system.

Conventional systems require the user to manually compensate for the parabolic offset angle. For example, the user orients the antenna dish so that the elevation of the antenna dish corresponds to the target elevation, and then adjusts the dish elevation to compensate for by the parabolic offset angle. Other conventional systems provide the elevation in degrees, compensated for the parabolic offset angle, stamped into a mechanical inclinometer, thus allowing the user to view the corresponding dish elevation as it is elevated. However, such conventional systems do not allow the user to remotely view the dish elevation.

For example, assume the parabolic offset angle is "twenty-four" degrees, and the target angle for a desired satellite is "forty-five" degrees for a given location. Furthermore, assume the satellite dish antenna is level so that there is no inclination angle. The user of a conventional system orients the satellite dish antenna to an elevation of "forty-five" degrees and then corrects the dish elevation "twentyfour" degrees to compensate for the offset angle. Alternatively, the user views the target angle corrected for the offset angle stamped into the mechanical inclinometer. However, the user is required to be within viewing distance of the stamped elevation markings.

An additional calculation is now required if the satellite dish antenna is not on a level surface. The user now has to compensate for the incline when calculating the corrected target elevation. However, unlike the target angle which is readily obtained from the satellite receiver, and the parabolic offset angle which is typically provided with the antenna system specifications, the user must separately measure or otherwise estimate the incline of the antenna dish. While some conventional systems provide a mechanical inclinometer which swings from the elevating tube to provide an approximate inclination, these systems require the user to view the elevation at the dish and do not provide the user with a remote display.

Conventional satellite dish antennas require additional time and are prone to user inaccuracies. Therefore, a need exists to provide the user of satellite antenna systems with a device that allows the user to accurately and easily target the satellite antenna dish to receive a satellite signal, without being leveled before use. A further need exists to provide the user with an accurate and easy to use device which will automatically compensate for the parabolic offset angle.

A need also exists to provide the user with a device which will automatically shut off to conserve battery power. A further need exists for a display that can be remotely viewed, including a display that can be mounted in close proximity to the satellite antenna dish controls.

A patentability search on the present invention was conducted and the results of this search are:

U.S. Pat. No. 4,707,699 utilizes an inclinometer attached to the antenna mount which is remotely sensed. Elevation control software controls the elevation drive motor. The control system automatically positions a portable parabolic fish antenna carried on the roof of a well logging truck. At a particular site, the earth's latitude and longitude is entered into the portable truck computer, the portable parabolic antenna is adjusted by the computer to a predetermined elevation (the base of the parabolic antenna has been reasonably leveled) and then, while keeping the elevation constant, the azimuth angle is swept slowly under computer control. When the satellite signal is detected, the satellite is locked in.

U.S. Pat. No. 5,227,806 pertains to a stabilized ship antenna system for satellite communication utilizing an inclination angle detector mounted on the AZ frame to detect an inclination angle. The elevation of the antenna is controlled by successive addition of the detected inclination angle to the control algorithm.

U.S. Pat. No. 5,077,561 sets forth a computerized antenna mount system for continuously tracking a satellite in geosynchronous orbit that has an inclined orbit with respect to the equator. The antenna mount automatically adjusts the declination angle of the ground station satellite antenna as a function of time after iteratively compiling the declination angle history from one complete orbit of a satellite. The adjustment is made by peaking the satellite signal received from the satellite turning.

None of the above patents provide a solution to the above stated needs.

SUMMARY OF THE INVENTION

1. Solution to the Problem.

The present invention solves the needs set forth above by providing an apparatus for targeting a satellite dish antenna to receive a signal from a satellite, that compensates for the inclination angle and parabolic offset angle of the satellite dish antenna. The present invention uses an inclinometer to detect the incline of the satellite dish antenna with respect to a tangent to the earth. The inclinometer further detects the elevation as the antenna is elevated by the user, thus providing a dish elevation which has been compensated for by the inclination. The inclinometer is coupled to a microprocessor which corrects the dish elevation for the parabolic offset angle of the dish. The microprocessor then provides the corrected dish elevation, compensated for both the inclination and the parabolic offset angle, to a display. The display can be remotely positioned apart from the satellite dish antenna itself so that a user can view the elevation on the display while adjusting the dish elevation until the displayed elevation equals the desired target elevation, at which point the satellite dish antenna has been accurately targeted to receive a signal from the satellite. Power to the present invention is controlled by an activation device, which automatically shuts off after a predetermined time, thus allowing the user to walk away from the present invention once it has been targeted, without having to check that it has been shut off.

2. Summary.

A targeting apparatus mounted to an RV for targeting an earth-based satellite dish antenna to receive a signal from a satellite. The targeting apparatus of the present invention can be elevated. An inclinometer housing, which houses an inclinometer, is mounted so as to move in unison with the satellite dish antenna. The inclinometer senses when the antenna system is oriented at an incline with respect to a tangent to the earth and further senses when the dish is elevated. The inclinometer thereby provides a dish elevation, as the dish is elevated, that has been compensated for by the inclination angle. A display housing also houses a microprocessor and digital display. The microprocessor is connected to receive the dish elevation from the inclinometer. The microprocessor corrects the dish elevation for the parabolic offset angle and provides a corrected dish elevation to the digital display. Thus, when the face of the antenna dish is perpendicular to the tangent of the earth, the digital display displays only the parabolic offset angle. The microprocessor, display and inclinometer are powered by a choice of sources controlled by an activation device. The activation device acts as a time-delayed switch, automatically switching off power to the microprocessor, inclinometer, and display after a predetermined time. The satellite dish antenna is elevated by a conventional moving device until the digital display displays a predetermined target elevation obtained from a conventional satellite receiver. Hence, the targeting apparatus allows the user to target the antenna dish to receive the satellite signal, having automatically been compensated for by the incline and parabolic offset angle of the satellite dish antenna.

BRIEF DESCRIPTION OF DRAWINGS

FIG. 7 shows the digital display of FIG. 6 mounted to a walilplate display unit, with power source, and a surface mount that the wallplate display unit is mounted to.

DETAILED DESCRIPTION OF THE INVENTION

1. Overview.

Figure 1:
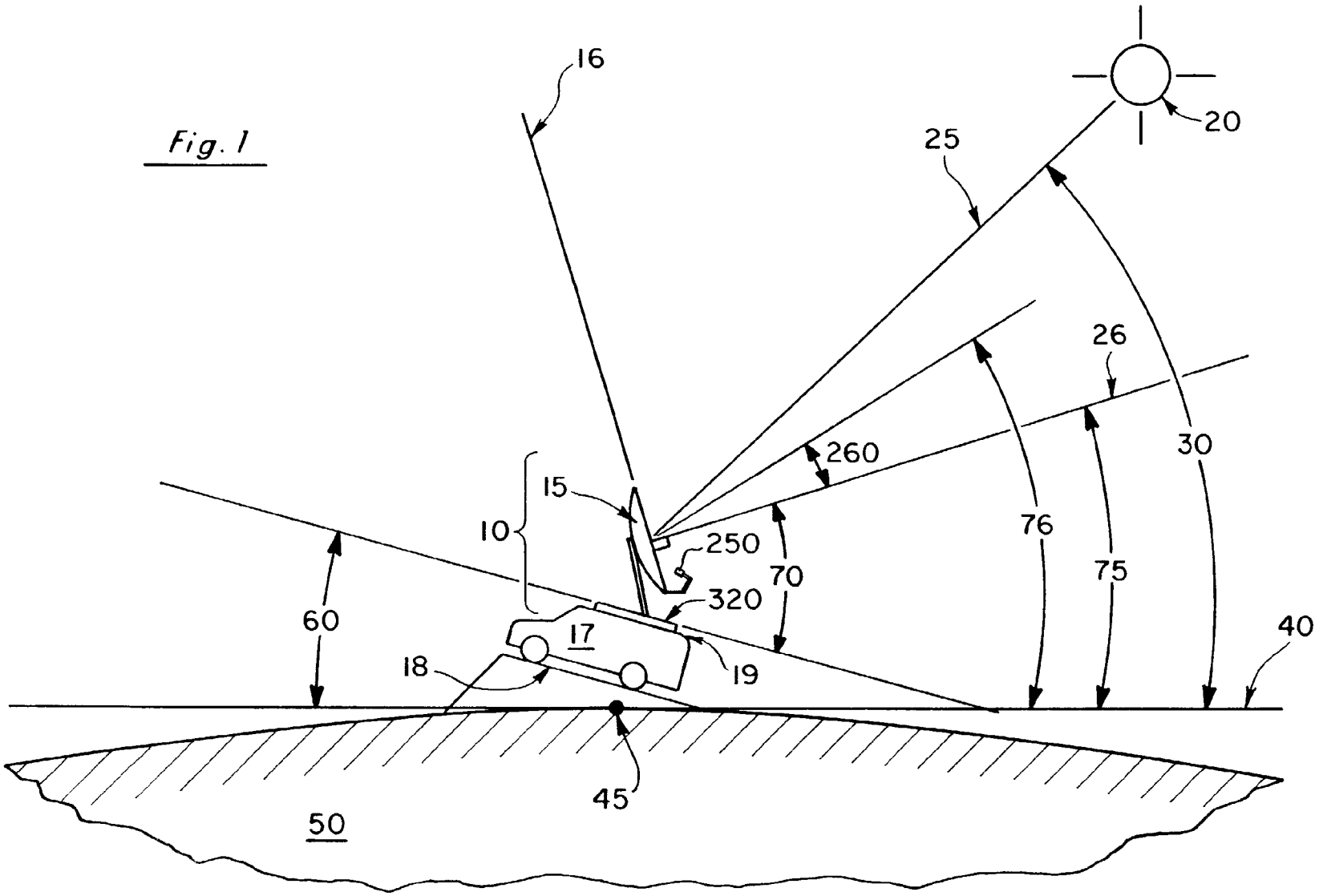
FIG. 1 sets forth a cross sectional, global perspective of the present invention, detailing the angles and elevations relative to a plane tangent to the surface of the earth and an incoming satellite signal.

In FIG. 1, a satellite antenna system 10 is shown mounted to the roof-top 19 of an RV 17. The RV 17 is shown parked on an incline 18, forming an inclination angle 60 between a base 320 of the satellite antenna system 10 and a plane 40 tangent to the surface of the earth 50 at a location 45. When the RV 17 is parked on a level surface, the inclination angle 60 is "zero." A target angle 30 exists between a signal 25 from a satellite 20 and the plane 40 tangent at location 45 of the earth 50. The target angle 30 is typically obtained by inputting the local zip code at location 45 into a satellite receiver system 390. Conventional satellite receiver systems 390 are typically purchased with the satellite dish antenna system 10, such as an RCA model DRD102RW, a SONY model SAT-B1, or a DISH NETWORK (ECHOSTAR) model ISD-2200. Alternatively, charts relating coordinates or area zip codes to satellite target elevations are also available, although these charts are typically not practical for consumer use.

A satellite dish antenna 15 is able to move through an elevation 70. Elevation 70 is measured between the base 320 and a plane 26 perpendicular to a face 16 of the satellite dish antenna 15. In the preferred embodiment, elevation 70 is equal to "zero" when the satellite dish antenna face 16 is upright (i.e., perpendicular to the plane 40 tangent to the surface of the earth 50). Dish elevation 75 represents the orientation of the satellite dish antenna 15 relative to the plane 26 perpendicular to the dish face 16, and the plane 40 tangent to the surface of the earth 50 at location 45. Dish elevation 75 is a function of the incline 60 and the elevation 70. For example, if inclination angle 60 is equal to "three" degrees, and the satellite dish antenna 15 is moved up (i.e., the dish face 16 moved away from the earth 50 in FIG. 1) "ten" degrees (e.g., elevation 70 is equal to "ten" degrees), the dish elevation 75, is equal to "seven" degrees (i.e., 10−3=7). Likewise, when the RV 17 is parked on an incline 18 opposite that shown in FIG. 1, inclination angle 60 is "negative." Thus, for example, if the inclination angle 60 is "negative three" degrees, and the elevation 70 is equal to "ten" degrees, the dish elevation 75 is equal to "thirteen" degrees (i.e., 10−(−3)=13). Similarly, as the dish 15 is moved down (i.e. the dish face 16 is moved toward the earth 50 in FIG. 1), elevation 70 is likewise considered "negative." It is to be expressly understood that the above examples are given to illustrate the operation of the present invention with respect to the various angles and elevations. However, operation of the present invention is not limited to these examples and the present invention is designed to handle any number of orientations.

A corrected elevation 76 represents the dish elevation 75 corrected for a parabolic offset angle 260. Corrected elevation 76 is equal to the sum of the dish elevation 75 and the parabolic offset angle 260. Corrected elevation 76 is viewed by the user on a display 332 (FIG. 3) while the satellite dish antenna 15 is elevated. The term elevated is used throughout this application to refer to elevating the satellite dish antenna in either direction. The satellite dish 15 is elevated until corrected elevation 76 is equal to the predetermined target elevation 30 obtained from the satellite receiver system 390. When corrected elevation 76 is equal to the target elevation 30, the satellite dish antenna 15 has been properly targeted to receive a signal 25 from the satellite 20.

The angles and elevations described in FIG. 1 are measured in reference to the plane 40 tangent to the surface of the earth 50 and were chosen simply to illustrate the present invention. However, these angles can be measured with reference to any number of points. The reference from which the angles are measured are immaterial to the present invention which provides a corrected dish elevation 76 which has been corrected for incline 60 and/or parabolic offset angle 260 which affect the corrected elevation 76 of the satellite dish antenna 15. Likewise, the angles may be measured in any other suitable form, such as radians. However, satellite antenna systems typically use measurements in degrees and therefore the measurements in the preferred embodiment will be described using degrees.

In addition, it is to be expressly understood that while FIG. 1 shows a satellite antenna system 10 mounted to the roof-top 19 of the RV 17, the present invention encompasses satellite antenna systems 10 that are mounted in various orientations, such as to the side of an RV, and to other vehicles (such as cars and trucks) and other support platforms. Indeed, the satellite antenna system 10 need not be mobile. For example, the satellite antenna system 10 may be fixedly mounted at location 45, such as to a building or house, in which case the present invention would allow the user to target the satellite dish antenna 15 at the satellite 20, though the satellite antenna system 10 has been mounted on a surface that is not level. In such a situation, the present invention would be particularly useful during installation and can be manufactured to be readily attached during installation and removed after installation. It will be readily apparent from the following description that the orientation of the satellite antenna system 10 is not important to the teachings of the present invention. However, in the following description, the present invention will be illustrated with the embodiment shown in FIG. 1 of the satellite antenna system 10 mounted to the RV 17.

Figure 2:
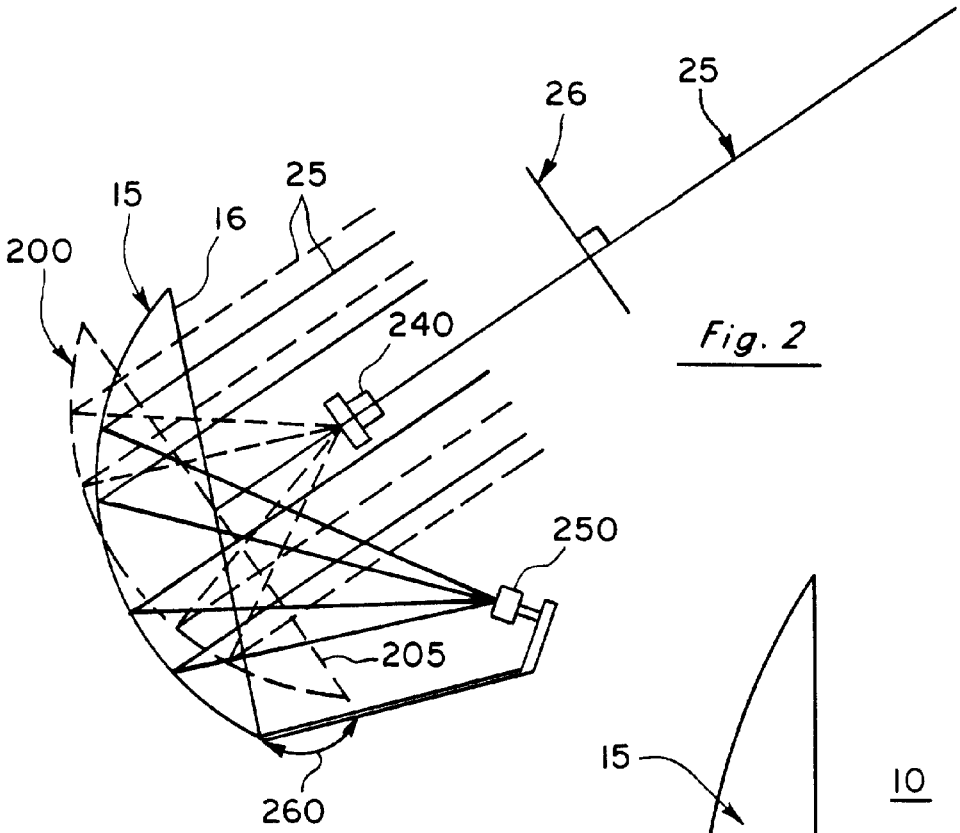
FIG. 2 is a cross-sectional view of a conventional satellite dish and a satellite dish built with a parabolic offset angle, to illustrate the parabolic offset angle.

FIG. 2 illustrates the parabolic offset angle 260. A conventional satellite dish antenna 200 is shown with the face 205 perpendicular 26 to a signal 25 from the satellite 20. The signal 25 strikes the conventional satellite dish antenna 200 and is subsequently reflected to the center feed 240 above the center of the conventional dish antenna 200. FIG. 2 also shows a satellite dish antenna 15 with an offset feed 250. To target the incoming signal 25 at the offset feed 250, the face 16 of dish 15 is offset by the parabolic offset angle 260 with respect to a plane 26 perpendicular to the signal 25. Thus, instead of signal 25 being reflected toward a center feed 240, the reflected signal is directed to the offset feed 250. The angle 260 is referred to as the parabolic offset angle 260 of the satellite dish antenna 15. The parabolic offset angle 260 is typically provided by the manufacturer with the antenna dish 15 specifications. In the preferred embodiment, the parabolic offset angle 260 is "twenty-four" degrees, however, the offset angle 260 may vary between manufacturers, or with the antenna dish 15 design itself. In fact, it is to be expressly understood that the present invention can also be used for conventional satellite dish antennas 200 without a parabolic offset angle 260. When the present invention is used with a conventional satellite dish antenna 200, the present invention is calibrated to reflect a parabolic offset angle 260 equal to "zero" and the present invention continues to compensate for the inclination angle 60.

Figure 3:
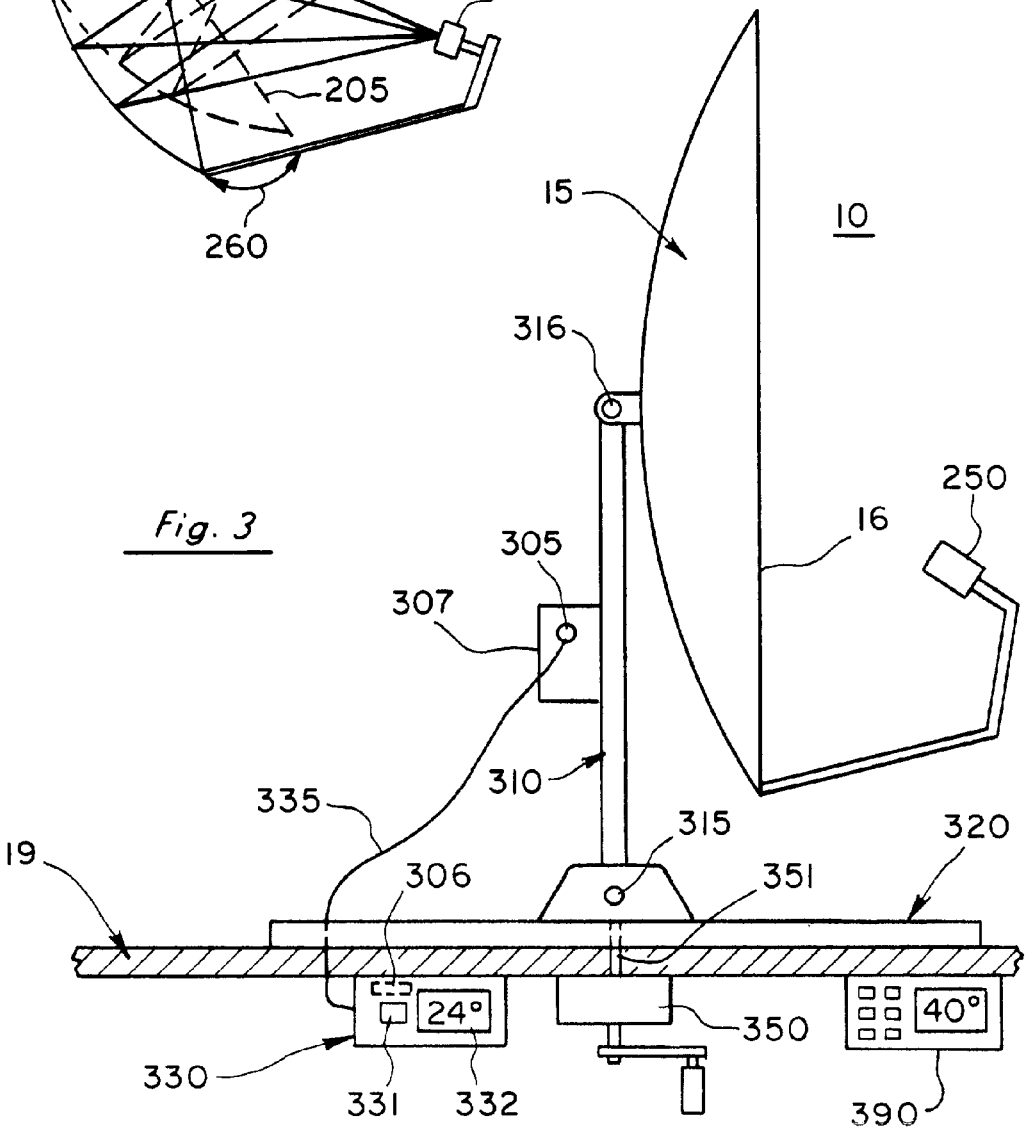
FIG. 3 sets forth a cut-away perspective of the major components of the present invention.

FIG. 3 shows the major components of the apparatus 10. A satellite dish 15 is shown connected to a base 320 by a support member 310. In the preferred embodiment, the dish 15 is fixedly mounted at a dish attachment 316 to the support arm 310 so as to allow the satellite dish 15 to move in unison with the support member 310 through elevation 70 about base attachment 315. However, it is to be expressly understood that the support member 310 can be fixedly mounted to the base 320, at the base attachment 315, allowing the satellite dish 15 to elevate about the support member 310 at the dish attachment 316. In another embodiment, the elevating tube 310 may pivot both at the base 320 about base attachment 315 and at the satellite dish antenna 15 about dish attachment 316, either simultaneously or alternatively. In addition, the elevating tube 310 is shown as a single-piece, straight tube in FIG. 3. The elevating tube 310 functions to support the dish 15 so that the dish 15 may be elevated. Therefore, elevating tube 310 can take any suitable form, such as an L-shape or curved design. Indeed, elevating tube 310 can be comprised of a plurality of components with pivot points at various locations between the components, which allow the dish 15 to be elevated. How the satellite dish antenna 15 is elevated is not important to the present invention. It is only important that the mechanical structure for elevating the dish 15 allows the inclinometer 305 to be mounted to move in unison with the satellite dish antenna 15.

An inclinometer 305 is shown mounted within a sensor housing 307 to the support member 310 for sensing both the inclination angle 60 and the elevation 70.

A display housing 330 is shown remotely connected by a conventional cable 335 to the inclinometer 305. A microprocessor 306 is shown mounted in the display housing 330 and connected by the cable 335 to the inclinometer 305 for receiving the dish elevation 75 from the inclinometer 305. The microprocessor 306 corrects the dish elevation 75 for the parabolic offset angle 260, and transmits the resulting corrected elevation 76 to a digital display 332, also housed in the display housing 330. In the preferred embodiment, the microprocessor 306 is housed within the display housing 330 and is remotely connected by the cable 335 to the inclinometer 305. However, it is to be expressly understood that the microprocessor 306 can be housed in any suitable location, including in the sensor housing 307, or in its own housing altogether. Likewise, the components (e.g. microprocessor 306 activation device 331, and display 332) housed in the display housing 330 may be remotely connected by means other than the cable 335, such as by radio frequency. In addition, the components housed in the display housing 330 can be housed next to the sensor housing 307, or in the sensor housing 307 itself. Indeed, the components housed in the display housing 330 and the components housed in the sensor housing 307 can each be housed independently or in any combination thereof. In the preferred embodiment, the digital display 332 and the activation device 331 are housed together to make the activation device 331 easily accessible while viewing the corrected elevation 76 on the display 332.

The digital display 332 is powered by a choice of power sources regulated by an activation device 331. Display 332 displays the corrected elevation 76 provided by the microprocessor 306.

A conventional moving device 350 is shown connected either to the base attachment 315, the dish attachment 316, or both attachments (315 and 316), for rotating the support member 310 and/or the satellite dish antenna 15, through elevation 70. Although the moving device 350 could be connected 351 to either attachment (315 or 316) or to both attachments (315 and 316), in the preferred embodiment, the satellite dish antenna 15 is fixedly mounted at dish attachment 316 to the support member 310 and elevates in unison with the support member 310 about base attachment 315. Therefore, in the preferred embodiment, the moving device 350 need only be connected to the base attachment 315. The moving device 350 can be any suitable device, and is typically purchased with the satellite dish antenna 15. The moving device 350 can be either manually or electronically driven, and functions to elevate the satellite dish antenna 15 through elevation 70. Moving device 350 is conventionally available and can be motorized (such as a conventional stepper motor), manual, lever or crank operated.

2. Details of the Sensor Housing, Inclinometer, and Mounting Plate.

Under the teachings of the present invention, an inclinometer 305, for sensing the incline 60 of the satellite antenna system 10 and the elevation 70 through which the dish 15 is moved, is housed in the sensor housing 307. Sensor housing 307 is mounted on the support member 310 so that the inclinometer 305 is parallel to the antenna dish face 16 and moves in unison with the satellite dish antenna 15. It is to be expressly understood that the inclinometer 305 may be mounted in any number of locations on the satellite antenna system 10. Indeed, the inclinometer 305 need not be mounted parallel to the face of the satellite dish antenna 15. For example, the inclinometer 305 may be mounted to the satellite dish antenna 15 itself, to an appendage of the satellite dish antenna 15, or to an appendage of the support member 310. Furthermore, the inclinometer 305 may be mounted at an angle. It will be readily apparent from the following description that the location and orientation of the inclinometer 305 may vary considerably under the teachings of the present invention. However, mounting the inclinometer 305 parallel to the dish face 16 when the face 16 is perpendicular to the plane 40 tangent to the surface of the earth 50, provides the greatest flexibility by allowing the inclinometer 305 to sense a greater range of inclines 60 in either direction. Therefore, in the following description, the present invention will be illustrated with the embodiment shown in FIG. 3, with the inclinometer 305 mounted parallel to the antenna face 16 to the support member 310 when the antenna face 16 is perpendicular to a plane 40 tangent to the surface of the earth 50.

The inclinometer 305 itself is conventionally available. The preferred embodiment uses the inclinometer 305 disclosed in U.S. Pat. No. 5,546,805 (Swartz et al.), and is built with a tolerance of ±1 degree. However, any suitable inclinometer 305 could be used without departing from the teachings of the present invention.

Figure 4:
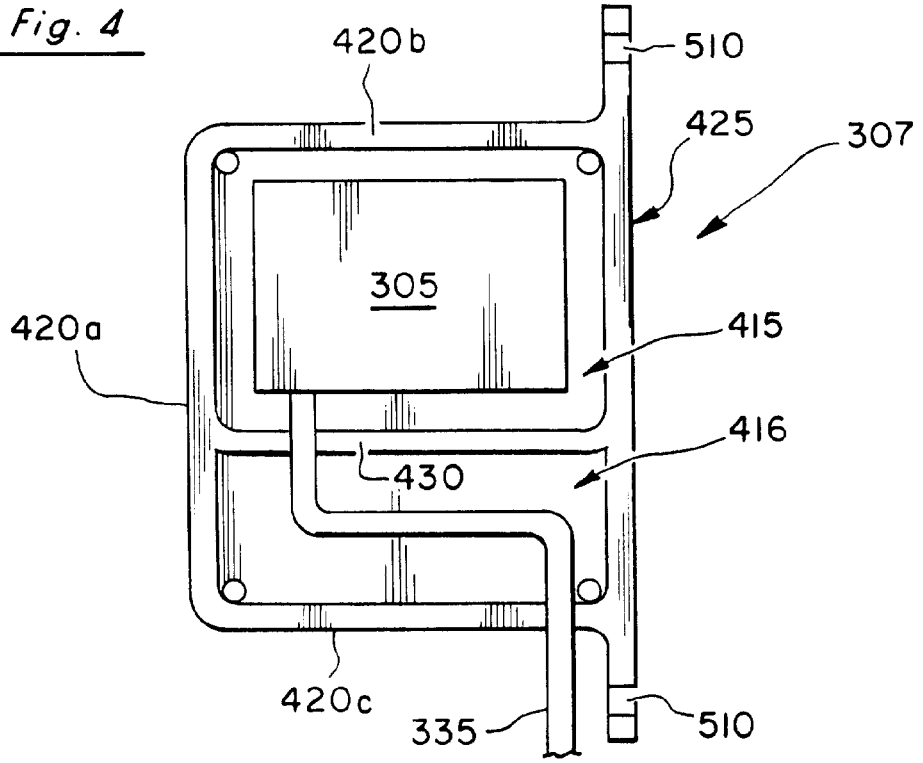
FIG. 4 is a cross sectional view of the inclinometer housing with the cover removed.
Figure 5:
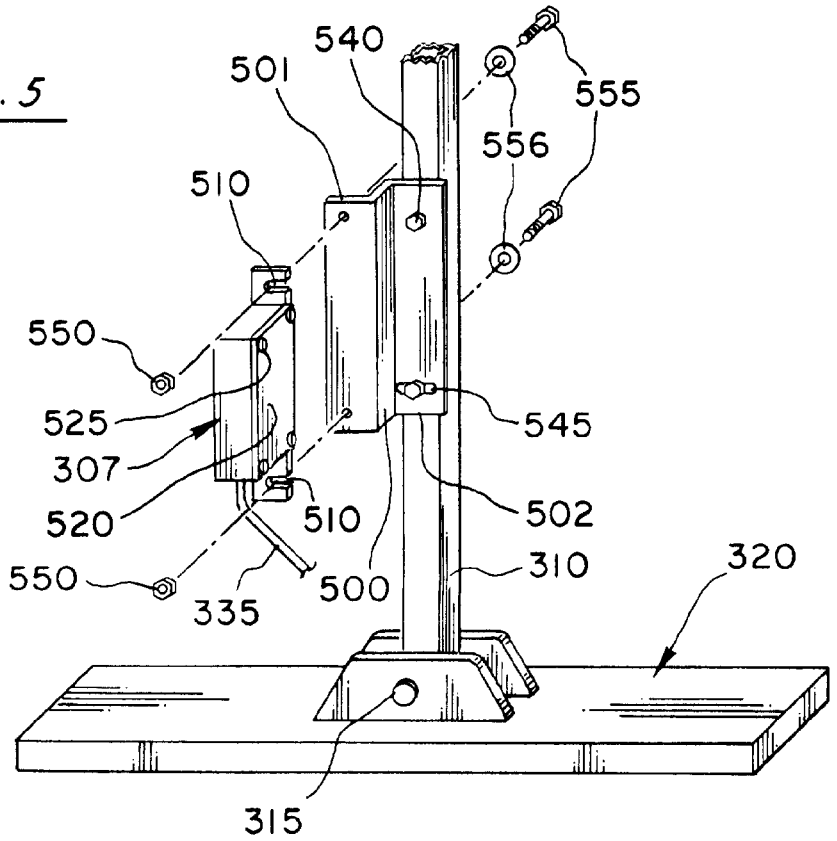
FIG. 5 is a side view of the inclinometer housing with the cover secured, and a mounting bracket, shown attached to the elevating tube of the present invention.

The inclinometer 305 is mounted within the sensor housing 307 illustrated in FIG. 4. The sensor housing 307 is machined from a suitable material such as a hard plastic. The sensor housing 307 has a back, three sidewalls 420*a*, 420*b*, and 420*c*, and a mounting wall 425. Two sidewalls 420*a* and 420*b*, mounting wall 425, and an interior wall 430 form an inclinometer cavity 415 in which the inclinometer 305 is located. A cable chamber 416 is also formed directly adjacent to the inclinometer cavity 415. A cable 335 leading from the inclinometer 305 exits the sensor housing 307 through the interior chamber 416 in a snake-like fashion to prevent water from seeping into the interior cavity 415 where the inclinometer 305 is housed. The mounting wall 425 extends outwardly from the interior region in both directions. The mounting wall 425 is grooved 510 on each end to allow a suitable securing means, such as screws 550, to secure the sensor housing 307 to a mounting plate 500, shown in FIG. 5. A cover 520 is secured using suitable securing means such as screws 525. A gasket (not shown) is provided between the cavity 415, the chamber 416, and the cover 520, as a weather tight seal.

The preferred embodiment described above offers the advantages of protecting the inclinometer 305 from the weather while providing a suitable means to mount the inclinometer 305 to the support arm 310. However, it is to be expressly understood that any suitable housing 307 can be used to house the inclinometer 305 without departing from the teachings of the present invention. In addition, the inclinometer 305 may be built into the support arm 310 itself, thus eliminating the need for separate housing 307 altogether.

In the preferred embodiment, a mounting plate 500 (FIG. 5) is formed in a step-like manner, allowing the inclinometer housing 307 to be mounted to a step 501. A second step 502 is mounted to the support member 310. The second step 502 has two holes 540 and 545 for securing the mounting plate 500 to the support arm 310. Hole 545 is formed in an oblong fashion to allow the plate 500 to be adjusted laterally before the plate 500 is fastened to the elevating tube 310. The mounting plate 500 is secured to the support member 310 with a suitable fastening means, such as a hex bolt/nut combination 555, through holes 540 and 545. Before the bolts 555 are tightened, the mounting plate 500 is able to slide about hole 540 through oblong hole 545 until the inclinometer is in the desired position, at which time the two bolts 555 can be tightened.

Mounting plate 500 functions to connect the inclinometer housing 307 to the support member 310. Any suitable means for mounting the inclinometer housing to the support member 310 can be used without departing from the teachings of the present invention. Mounting plate 500 need not be fashioned in a step-like manner and may be, for example, L shaped, or a flat plate. Indeed, the use of a mounting plate 500 is not required for the function of the present invention. The inclinometer housing 307 may be mounted directly to support member 310.

3. Details of the Display Housing. Display Device and Microprocessor.

Figure 6:
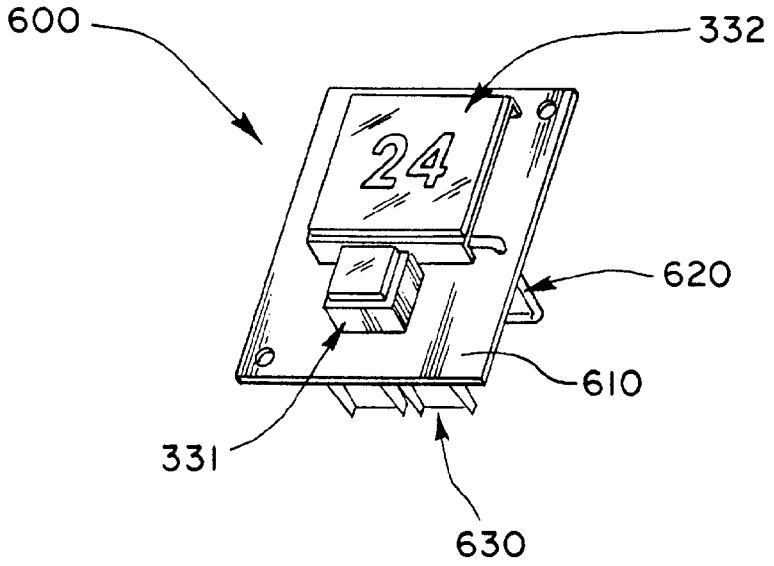
FIG. 6 is a top view of the display board showing the printed circuit board with a digital display and activation device.
Figure 7:
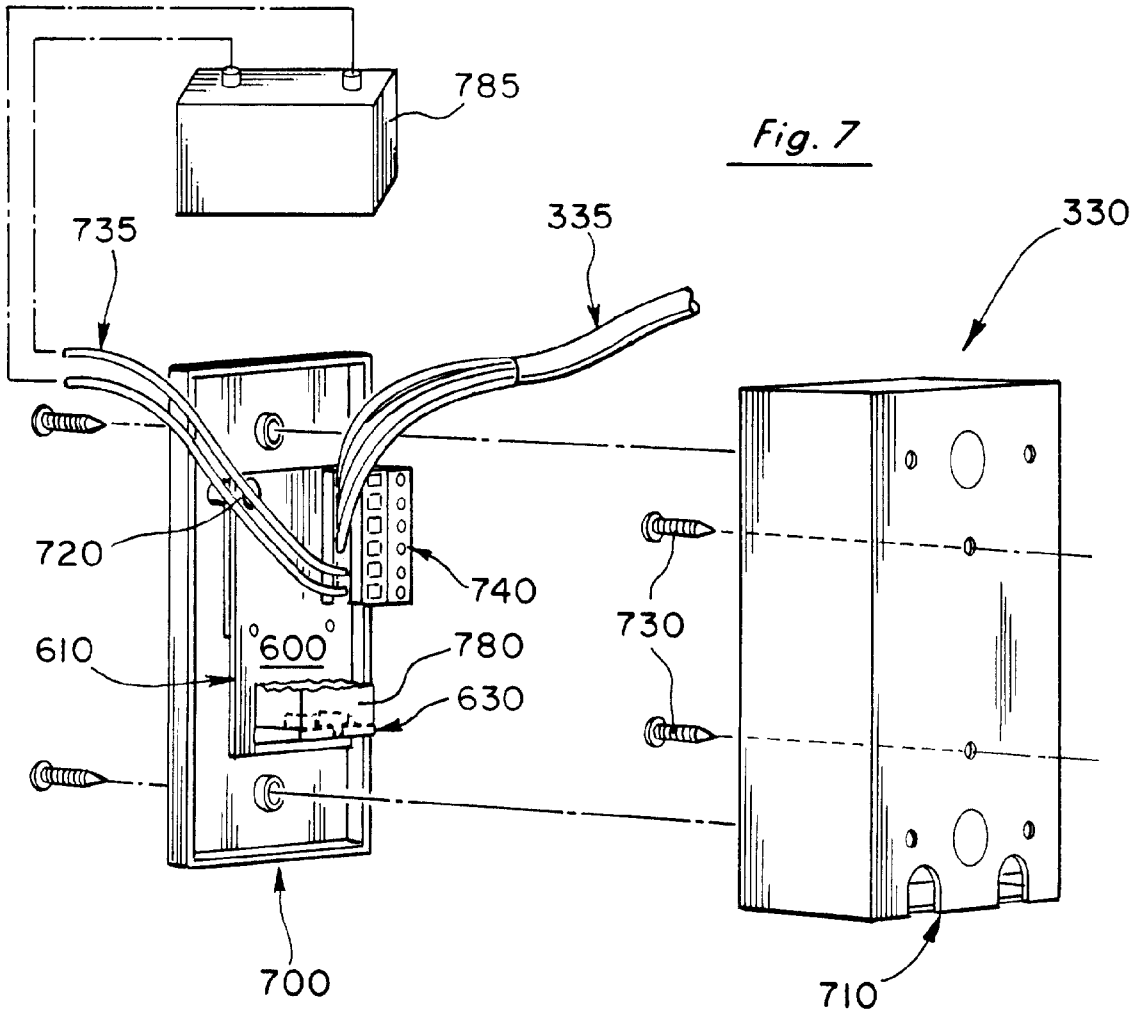

FIGS. 6 and 7 illustrate the display board 600. The face of the display board 600 is seen in FIG. 6, and the reverse side of the display board 600 is seen in FIG. 7 mounted to a wallplate display unit 700. The display board 600 comprises the digital display 332, the microprocessor 306 (not shown in FIGS. 6 or 7), the activation device 331, and an input connector 740. A battery 780 is connected to terminals 630. In the alternative, an external power supply 785 is attached with wires 735 to the input connector 640 mounted on the printed circuit board 610. The microprocessor 306 is connected through a printed circuit board 610 to the inclinometer 305 and the digital display 332. The activation device 331 acts as a time-delayed switch, allowing the microprocessor 306 and digital display to be powered for a predetermined time, then automatically shutting off to keep the power source from being drained between use. The input connector 740 connects the display board 600 to the inclinometer 305 through cable 335. The input connector 740 also acts as the connection for an optional external power supply 785.

The source of power is not important to the teachings of the present invention. For example, power can be provided to the present invention from disposable batteries, an AC power supply, the RV 17, or solar power.

Although in the preferred embodiment, the display 332 is digital, the current invention would be equivalent by employing an analog display or any other suitable display, such as a liquid crystal display (LCD) or computer monitor. In addition, the activation device 331 need not be manual nor time-delayed. For example, the display 332 could be activated when the microprocessor 306 senses a dish elevation 75 which is different from that previously received from the inclinometer 305. Alternatively, activation device 331 could be both activated and deactivated by the user. Indeed, the activation device 331 need not be a button, as shown in the drawings, and may be any suitable device, such as a switch, a dial, or a touch pad. In the alternative, power could be constantly applied to the present invention, therefore eliminating the need for the activation device 331. However, the activation device 331 of the preferred embodiment provides a convenient and efficient means of controlling power, and therefore the present invention will be described with an activation device 331.

Microprocessor 306 is conventionally available. The microprocessor 306 functions to receive an input signal from the inclinometer for the dish elevation 75 and corrects the dish elevation 75 by correcting for the parabolic offset angle 260 to the dish elevation 75 to obtain the corrected elevation 76. Corrected elevation 76 is subsequently transmitted to the digital display 332.

The display housing 330 is shown in detail in FIG. 7. The display housing 330 houses the display board 600 mounted to the wallplate display unit 700 and attached within a surface mount box 710 so as to protect the display board 600 while allowing the user to view corrected elevation 76 on the digital display 332. The display board 600 is mounted to the interior of the wallplate display unit 700 using two fastening means such as screws 720. The display device is secured to a remote location , such as the interior wall of the RV 17, using securing means such as two screws 730. The wallplate display 710 is then connected to the surface mount box 710 using the two screws 720, much like the faceplate of a home electric wall outlet is assembled.

It is to be expressly understood that modifications to certain structural features shown in the drawing can be made without departing from the teachings of the present invention. Equivalent designs could encompass a single molded housing 330, or a housing 330 made of an equivalent material, such as a metal alloy. Likewise, any number of securing means could be used, such as bolts, screws, glues, or welds. The display housing 330 functions to house the display 332, and in the preferred embodiment, the microprocessor 306. However, the precise design of the housing 330 is not important to the function of the targeting device. Indeed, the display 332 and microprocessor 306 need not be housed in a specific housing. For example, the display 332 and the microprocessor 306 can be housed in the dash board of the RV 17, in conventional computer casing, or in a wall of the RV 17.

4. Calibration, Assembly, and Method for Operation.

The present invention must be calibrated to compensate for the parabolic offset angle 260 of the satellite dish antenna 15. The precise offset angle 260 will depend on the manufacturer and/or design of the dish antenna 15. In the preferred embodiment, the offset angle 260 (e.g., "twenty-four" degrees). The microprocessor 306 is programmed to transmit to the display 332 the parabolic offset angle 260 equal to "twenty-four" degrees when the inclinometer 305 is perpendicular to the plane 40 tangent to the surface of the earth 50 (e.g., when the inclinometer senses inclination angle 60 and elevation 70 are "zero").

Once the satellite antenna system 10 is installed, the present invention is assembled as follows. The Sensor 305 is temporarily assembled to the elevating tube 310. A level or other equivalent device such as a square is placed across the antenna face 16 and the antenna 15 is raised until the dish face 16 is perpendicular to the plane 40 tangent to the earth 50. The activation device 331 is depressed and the sensor 305 is adjusted until the display 332 displays the parabolic offset angle 260 (i.e., "twenty-four" degrees). The sensor 305 is fixedly mounted to elevating tube 310.

Once the present invention is calibrated and assembled, the user is able to move to any location 45 on the surface of the earth 50 for which the user is able to receive a satellite signal 25. The user obtains the target angle 30 from the conventional satellite receiver 390 for the chosen location 45. The user depresses the activation device 331 which activates digital display 332. The corrected elevation 76 of the satellite dish antenna 15, compensated both for the inclination angle 60, if any, and the parabolic offset angle 260, if any, is displayed on display 332. The user operates moving device 350 until the displayed elevation 76 equals the target elevation 30, at which point, the satellite is properly targeted to receive the satellite signal 25 at location 45.

Figure 8A:
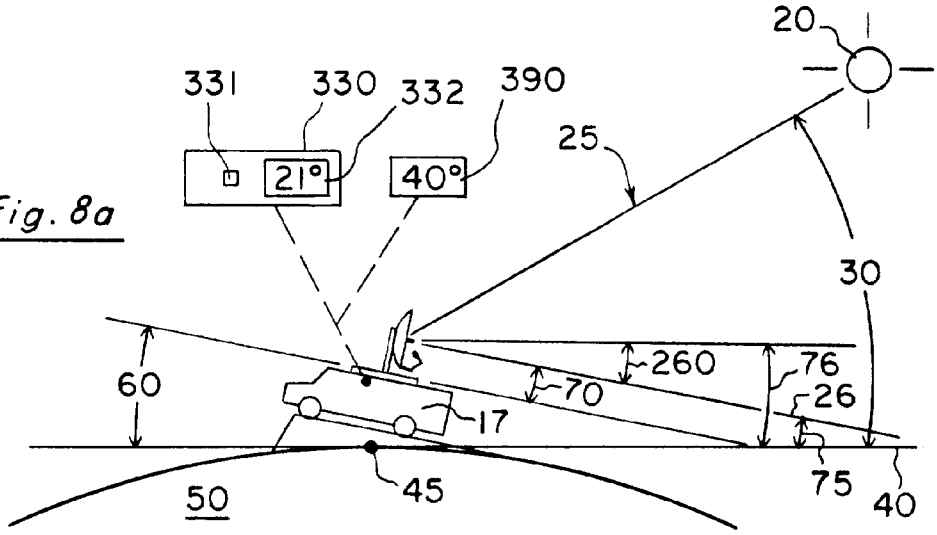
FIGS. 8*a, b*, and *c* show an example of the satellite dish antenna being targeted to receive the satellite signal.
Figure 8B:
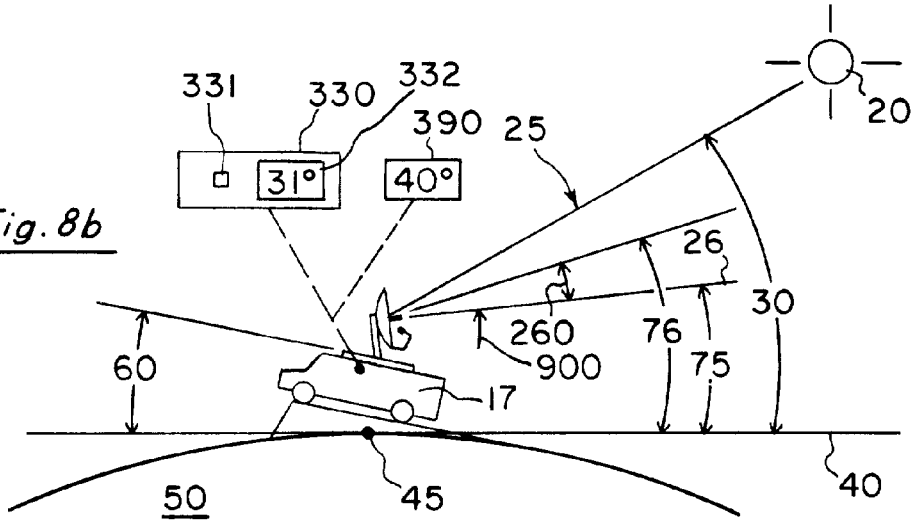
Figure 8C:
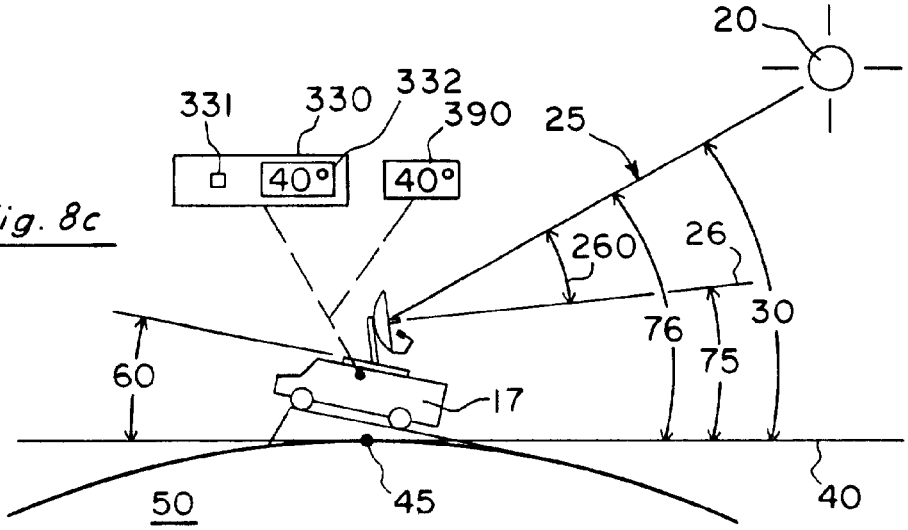

For example, assume a satellite dish antenna 10, has a built-in parabolic offset angle 260 of "twenty-four" degrees. The user drives the RV 17 to a location 45 where the target angle 30 for receiving signal 25 from satellite 20 is "forty" degrees, and parks on incline 60 equal to "three" degrees, illustrated in FIGS. 8*a*, 8*b*, and 8*c*. Assume, for the purpose of this example, that the support member 310 has been positioned upright as in FIG. 8*a* (e.g., elevation 70 equals "zero"), although any prior elevation 70 the antenna system 10 is oriented will be compensated for and displayed by the present invention. First, the user obtains the reading "forty" degrees from the satellite receiver 390. The user operates activation device 331, to activate the display 332. Display 332 displays "twenty-one" degrees (e.g., the parabolic offset angle 260 equal to "twenty-four" degrees, minus the inclination angle of "three" degrees; elevation 70 equals "zero"). The target angle 30 is "forty" degrees, therefore the user operates moving device 350, to elevate the satellite dish antenna 15, "nineteen" degrees in direction 900 (FIG. 8*b*) until display 332 reads "forty." Thus, the satellite dish antenna 15 has been properly targeted and is ready to receive the satellite signal 25, the satellite dish antenna 15 orientation having been compensated both for the inclination angle 60 and the parabolic offset angle 260, FIG. 8*c*.

The above example is not intended to limit the scope of the present invention. Any number of situations may occur during normal use, in which the inclination angle 60, parabolic offset angle 260, target angle 30 or orientation of the satellite dish antenna 15 may vary. In addition, the present invention would be equivalent if certain tasks were performed by a microprocessor. For example, the user may input the target elevation or the zip code or coordinates of location 45, and the satellite dish antenna 15 automatically orients itself to receive signal 25.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

We claim:

1. A method for targeting a satellite dish antenna at a satellite from a location on a surface of earth, said method comprising the steps of:

obtaining a target elevation for the satellite at the location, automatically measuring a dish elevation of the satellite dish antenna at the location compensated for by an inclination angle with respect to a tangent to said location, compensating said dish elevation for a parabolic offset angle to obtain a corrected dish elevation, displaying the corrected dish elevation of the satellite dish antenna, moving the satellite dish antenna until the corrected dish elevation displayed equals the target elevation, thereby targeting the satellite dish antenna at the satellite.

2. The method for targeting the satellite dish antenna of claim 1 wherein the dish elevation is automatically measured with an inclinometer.

3. A method for targeting a satellite dish antenna at a satellite from a location on a surface of earth, said method comprising the steps of:

obtaining a target elevation for the satellite at the location, automatically measuring a dish elevation of the satellite dish antenna at the location compensated for by an inclination angle, compensating said dish elevation for a parabolic offset angle to obtain a corrected dish elevation, wherein the parabolic offset angle is compensated based on an output signal produced by a microprocessor, displaying the corrected dish elevation of the satellite dish antenna, moving the satellite dish antenna until the corrected dish elevation displayed equals the target elevation, thereby targeting the satellite dish antenna at the satellite.

4. An apparatus at a location on earth for targeting a satellite dish antenna at a satellite in order to receive a signal from said satellite, said apparatus comprising:

a support member;

a face of said satellite dish antenna;

a base, said satellite dish antenna connected to said base by said support member so that said satellite dish antenna is able to move through an elevation;

an inclinometer mounted to move in unison with said satellite dish antenna for sensing when said base is oriented at an inclination angle with respect to a tangent to said location on said earth, said inclinometer further sensing when a plane perpendicular to said face moves through said elevation, said inclinometer thereby providing a dish elevation;

a microprocessor connected to said inclinometer for providing a predetermined parabolic offset angle, said microprocessor thereby providing a corrected dish elevation;

a display means connected to said microprocessor for displaying said corrected dish elevation;

means attached to said satellite dish antenna for moving said face of said satellite dish antenna through said elevation until said display means displays a predetermined target elevation so as to target said satellite dish antenna at said satellite.

5. The apparatus of claim 4 wherein said satellite dish antenna is pivotally connected to said base by said support member, said satellite dish antenna and said support member mounted to move in unison through said elevation.

6. The apparatus of claim 4 wherein said parabolic offset angle is equal to twenty-four degrees.

7. The apparatus of claim 4 wherein said display means is activated by an activation device.

8. The apparatus of claim 4, wherein said display means is powered by a choice of sources.

9. The apparatus of claim 4, wherein said display means is a digital display.

10. The apparatus of claim 7, wherein said display means is deactivated automatically after a predetermined period of time.

11. The apparatus of claim 7, wherein said display means is positioned remotely from said satellite dish antenna.

12. An apparatus at a location on earth for targeting a satellite dish antenna at a satellite in order to receive a signal from said satellite, said apparatus comprising:

an elevating tube for rotating said satellite dish antenna through an elevation, said elevation measured between a plane perpendicular to said face of said satellite dish antenna and said base;

a face of said satellite dish antenna;

a base, said satellite dish antenna connected to said base by said elevating tube so that said satellite dish antenna is able to move through said elevation;

an adjustable mounting plate;

an inclinometer housing mounted using said mounting plate to move in unison with said satellite dish antenna;

an inclinometer fixedly housed within said inclinometer housing for sensing when said base is oriented at an inclination angle with respect to a tangent to said location on said earth, said inclinometer further sensing when said plane perpendicular to said face moves through said elevation, said inclinometer thereby providing a dish elevation, said dish elevation equal to the difference between said elevation and said inclination angle;

a display housing;

a microprocessor housed within said display housing and connected to said inclinometer for providing a predetermined parabolic offset angle when said dish face 16 is perpendicular to said tangent, said parabolic offset angle equal to the angle between said face of said satellite dish antenna and a plane perpendicular to said signal, said microprocessor thereby providing a corrected angle, said corrected angle equal to the sum of said parabolic offset angle and said dish elevation sensed by said inclinometer;

a circuit board;

a display means housed within said display housing connected to said microprocessor through said circuit board for displaying said corrected angle;

a power supply, for providing electric power to said display means and microprocessor through said circuit board;

an activation device housed within said display housing, said activation device connected through said circuit board to said display means for regulating electric power to said display means;

means attached to said satellite dish antenna for rotating said satellite dish antenna through said elevation until said display means displays a predetermined target elevation so as to target said face to receive said signal from said satellite, said predetermined target elevation measured between said signal and said tangent.

13. The apparatus of claim 12 wherein said satellite dish antenna is pivotally connected to said base by said support member, said satellite dish antenna and said support member mounted to move in unison in through said elevation.

14. The apparatus of claim 12 wherein said parabolic offset angle is equal to twenty-four degrees.

15. The apparatus of claim 12 wherein said display means is a digital display.

16. The apparatus of claim 12 wherein said display means is positioned remotely from said satellite dish antenna.

* * * * *

UNITED STATES PATENT AND TRADEMARK OFFICE

CERTIFICATE OF CORRECTION

PATENT NO. : 5,945,945
DATED : August 31, 1999
INVENTOR(S) : David W. Wagner and William J. Sherwood It is certified that error appears in the above-indentified patent and that said Letters Patent is hereby corrected as shown below:

Column 2, Line 21, replace "twentyfour" with --twenty-four--

Column 2, Line 59, replace "fish" with --dish--

Column 10, Line 51, replace "satellite dish antenna 10" with --satellite dish antenna 15--

Column 12, Line 42, replace "said base" with --a base--

Column 12, Line 44, replace "a base" with --said base--

Column 12, Line 62, replace "dish face 16" with --dish face--

Column 14, Line 6, replace "said support member" with --said elevating tube--

Column 14, Line 7, replace "said support member" with --said elevating tube--

Signed and Sealed this

Twenty-third Day of May, 2000

*Attest:*

Q. TODD DICKINSON

*Attesting Officer*

*Director of Patents and Trademarks*